US006102359A

United States Patent [19]

Almeida

[11] Patent Number: 6,102,359

[45] Date of Patent: Aug. 15, 2000

[54] SKID PLATE FOR PROTECTING THE BOTTOM OF A CENTRAL AIR-CONDITIONING UNIT FROM DAMAGE CAUSED BY TRANSPORT AND CORROSION

[76] Inventor: Jeffrey Almeida, 1578 Niemeyer Cir., Port St. Lucie, Fla. 34952

[21] Appl. No.: 09/129,438

[22] Filed: Aug. 5, 1998

[51] Int. Cl.[7] ..... F16M 1/00

[52] U.S. Cl. ..... 248/677

[58] Field of Search ..... 248/637, 638, 248/678, 188.9, 346.01, 188.8, 310; 16/404; 29/525.01

[56] References Cited

U.S. PATENT DOCUMENTS

| | | | |
|---|---|---|---|
| 3,934,356 | 1/1976 | Bryant | 35/13 |
| 3,962,660 | 6/1976 | Duckett | 336/65 |
| 4,331,234 | 5/1982 | Gilbert | 206/320 |
| 5,664,394 | 9/1997 | Sweeney | 52/782.1 |
| 5,833,206 | 11/1998 | Peacock | 248/677 |
| 5,887,962 | 3/1999 | Tsai | 248/677 X |

*Primary Examiner*—Ramon O. Ramirez

*Attorney, Agent, or Firm*—Richard L. Miller, Registered Patent Agent

[57] ABSTRACT

A skid plate for protecting the base of a central air-conditioning unit from damage caused by transport and corrosion, wherein the base of the central air-conditioning unit has feet depending therefrom with holes therein. The skid plate includes a plate that is slender, elongated, flats and rectangular-parallelepiped-shaped, and has an uppermost face for contacting at least one foot of the feet on the base of the central air-conditioning unit, a lowermost face for contacting a concrete slab upon which the central air-conditioning unit is to rest, and a pair of throughbores that extend from the uppermost face of the plate to the lowermost face of the plate and which are axially spaced apart a distance equivalent to that distance between, and alignable with, a pair of adjacent holes of the holes in the feet on the base of the central air-conditioning unit. The plate is replaceably attached to the feet on the base of the central air-conditioning unit by bolts that enter the pair of throughbores in the plate and threadably engage in the pair of adjacent holes of the holes in the feet on the base of the central air-conditioning unit. The plate is replaceably attached to the feet on the base of the central air-conditioning unit to allow for its replacement when necessary.

20 Claims, 4 Drawing Sheets

SKID PLATE FOR PROTECTING THE BOTTOM OF A CENTRAL AIR-CONDITIONING UNIT FROM DAMAGE CAUSED BY TRANSPORT AND CORROSION

BACKGROUND OF THE INVENTION

1. Field of the Invention

The present invention relates to a skid plate. More particularly, the present invention relates to a skid plate for protecting the bottom of a central air-conditioning unit from damage caused by transport and corrosion.

1. Description of the Prior Art

After a central air-conditioning unit is manufactured it is sent to a distributor, then to a dealer, and then to its final installation site. During all this transporting the base of the units become severely scraped, usually down to bare metal, in turn allowing corrosion to begin almost immediately.

An apparent possible solution is to attempt to repair the shipping damage. These efforts, however, proved futile because after the units were repaired, they would then be loaded onto trucks and then slide onto concrete slabs, in turn creating new damage.

Numerous innovations for appliance related devices have been provided in the prior art that will be described. Even though these innovations may be suitable for the specific individual purposes to which they address, however, they differ from the present invention.

A FIRST EXAMPLE, U.S. Pat. No. 3,934,356 to Bryant teaches a teaching aid which incorporates a closed chamber, preferably insulated, which receives therein the air distribution portion of a heating and air conditioning system. The apparatus utilizes a complete miniaturized refrigerant system which has a sealed compressor unit, an evaporator, a condenser, and the appropriate lines connecting the various components. In the preferred embodiment, a removable skid mounted base supports the condenser and compressor.

A SECOND EXAMPLE, U.S. Pat. No. 3,962,660 to Duckett teaches a ground level transformer and a pallet-pad, the pad being formed from a lightweight material and having on one side supporting surfaces of sufficient strength to form a pad mount base for the transformer and a surface for transporting the transformer unit by a fork lift truck and on the other side a number of latching points for accommodating a number of different size transformers, and a tamper proof ridge positioned to correspond to the dimensions of the various size transformers. The pad is permanently attached to the transformer for installation on site. The transformer unity can be stacked for storage and shipped as a unit.

A THIRD EXAMPLE, U.S. Pat. No. 4,331,234 to Gilbert teaches a shipping container for appliances or the like that comprises in combination an outer container element and a base pad element. The outer container element includes scored bottom closure flaps which are folded to provide integral skid type runners at the bottom thereof and the base pad element is formed from a cut and scored blank that is folded to produce a triple thick construction which is secured to the appliance or the like.

FOURTH EXAMPLE, U.S. Pat. No. 5,664,394 to Sweeney teaches a base for equipment, including a pad having a top surface, a plurality of side surfaces,and a core with a bottom side. The core has at lease one recess in its bottom side. At least on removable insert foot mates with the at least one core recess such that the insert foot extends beyond the bottom side of the core. Similarly, rather than using a pad with a core, the pad is hollow with a top surface, a bottom surface, and a plurality of side surfaces. The bottom surface has at least one recess therein for mating with at least one removable insert foot. Likewise, the pad can have a top, a bottom, and a plurality of side surface with the bottom surface having a plurality of supports ribs extending therefrom. A removable pallet insert or a plurality of removable pallet sleds with a plurality of feet mate with the ribs on the bottom surface such that the feet extend beyond the bottom surface of said pad.

It is apparent that numerous innovations for appliance related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a skid plate for protecting the base of a central air-conditioning unit from damage caused by transport and corrosion that avoids the disadvantages of the prior art.

ANOTHER OBJECT of the present invention is to provide a skid plate for protecting the base of a central air-conditioning unit from damage caused by transport and corrosion that is simple and inexpensive to manufacture.

STILL ANOTHER OBJECT of the present invention is to provide a said plate for protecting the base of a central air-conditioning unit from damage caused by transport and corrosion that is simple to use.

BRIEFLY STATED, YET ANOTHER OBJECT of the present invention is to provide a skid plate for protecting the base of a central air-conditioning unit from damage caused by transport and corrosion, wherein the base of the central air-conditioning unit has feet depending therefrom with holes therein. The skid plate includes a plate that is slender, elongated, flat, and rectangular-parallelepiped-shaped, and has an uppermost face for contacting at least one foot of the feet on the base of the central air-conditioning unit, a lowermost face for contacting a concrete slab upon which the central air-conditioning unit is to rest, and a pair of throughbores that extend from the uppermost face of the plate to the lowermost face of the plate and which are axially spaced apart a distance equivalent to that distance between, and alignable with, a pair of adjacent holes of the holes in the feet on the base of the central air-conditioning unit. The plate is replaceably attached to the feet on the base of the central air-conditioning unit by bolts that enter the pair of throughbores in the plate and threadably engage in the pair of adjacent holes of the holes in the feet on the base of the central air-conditioning unit. The plate is replaceably attached to the feet on the base of the central air-conditioning unit to allow for its replacement when necessary.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
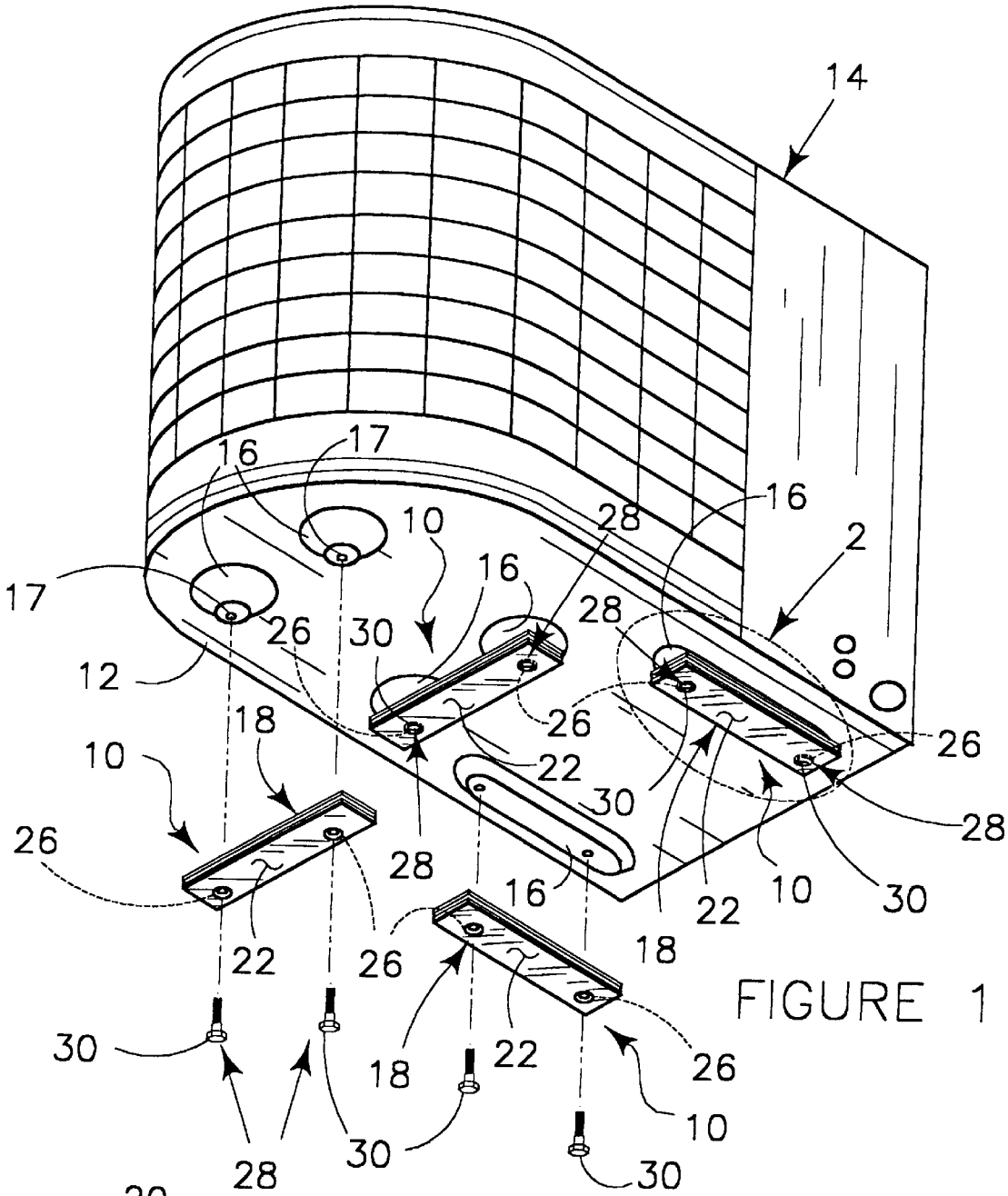
FIG. 1 is a diagrammatic perspective view of a central air-conditioning unit with the present invention already installed on, and being installed on, the base thereof.

10 skid plate for protecting the base of a central air-conditioning unit from damage caused by transport and corrosion of the present invention
12 base of central air-conditioning unit 14
14 central air-conditioning unit
16 feet depending from base 12 of central air-conditioning unit 14
17 holes in feet 16
18 plate
20 uppermost face of plate 18 for contacting at least one foot of feet 16 on base 12 of central air-conditioning unit 14
22 lowermost face of plate 18 for contacting concrete slab 24 upon which central air-conditioning unit 14 is to rest
24 concrete slab upon which central air-conditioning unit 14 is to rest
26 pair of throughbores in plate 18
28 bolts
30 heads of bolts 28

DETAILED DESCRIPTION OF THE PREFERRED EMBODIMENT

Referring now to the figures, in which like numerals indicate like parts, and particularly to FIG. 1, the skid plate for protecting the base of a central air-conditioning unit from damage caused by transport and corrosion of the present invention is shown generally at 10 for protecting the base 12 of a central air-conditioning unit 14 from damage caused by transport and corrosion, wherein the base 12 of the central air-conditioning unit 14 has feet 16 depending therefrom with holes 17 therein.

Figure 2:
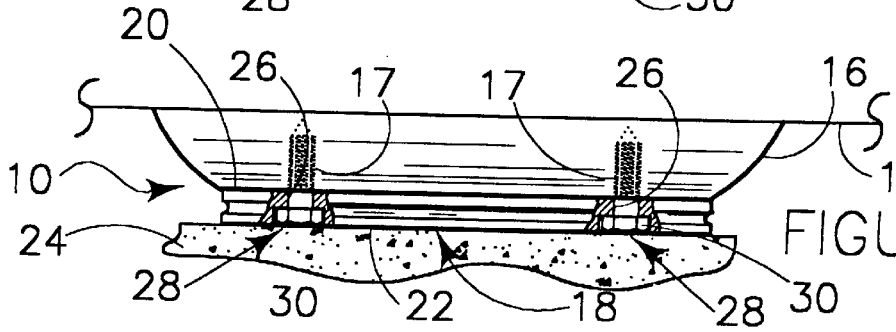
FIG. 2 is an enlarged diagrammatic side elevational view of the area generally inclosed in the dotted ellipse identified by arrow 2 in FIG. 1 of the present invention installed on the base of the central air-conditioning unit.

The configuration of the skid plate for protecting the base of a central air-conditioning unit from damage caused by transport and corrosion 10 can best be seen in FIGS. 1 and 2, and as such will be discussed with reference thereto.

The skid plate for protecting the base of a central air-conditioning unit from damage caused by transport and corrosion 10 comprises a plate 18 that is slender, elongated, flat, and rectangular-parallelepiped-shaped, and has an uppermost face 20 for contacting at least one foot of the feet 16 on the base 12 of the central air-conditioning unit 14, and a lowermost face 22 for contacting a concrete slab 24, upon which the central air-conditioning unit 14 is to rest.

The plate 18 further has a pair of throughbores 26 that extend from the uppermost face 20 of the plate 18 to the lowermost face 22 of the plate 18 and which are axially spaced apart a distance equivalent to that distance between, and alignable with, a pair of adjacent holes of the holes 17 in the feet 16 on the base 12 of the central air-conditioning unit 14, with the plate 18 being replaceably attached to the feet 16 on the base 12 of the central air-conditioning unit 14 by bolts 28 that enter the pair of throughbores 26 in the plate 18 and threadably engage in the pair of adjacent holes of the holes 17 in the feet 16 on the base 12 of the central air-conditioning unit 14, with the bolts 28 having heads 30, and with the plate 18 being replaceably attached to the feet 16 on the base 12 of the central air-conditioning unit 14 to allow for its replacement 11 when necessary.

The plate 18 can be plastic, preferably either poly-vinyl-chloride (PVC) or a fluorocarbon polymer with slippery, non-sticking properties, sold under the tradename TEFLON (TM), and which is for facilitating pushing the central air-conditioning unit 14, as a result of its lower coefficient of friction.

The plate 18 can be metal, preferably stainless steel, which resists corrosion.

The pair of throughbores 26 in the plate 18 are counterbored on the lowermost face 22 of the plate 18, a depth sufficient for preventing the heads 30 of the bolts 28 from protruding past the lowermost face 22 of the plate 18, and with a width sufficient for allowing a socket wrench (not shown) to properly engage the heads 30 of the bolts 28 and turn the bolts 28.

Figure 3A:
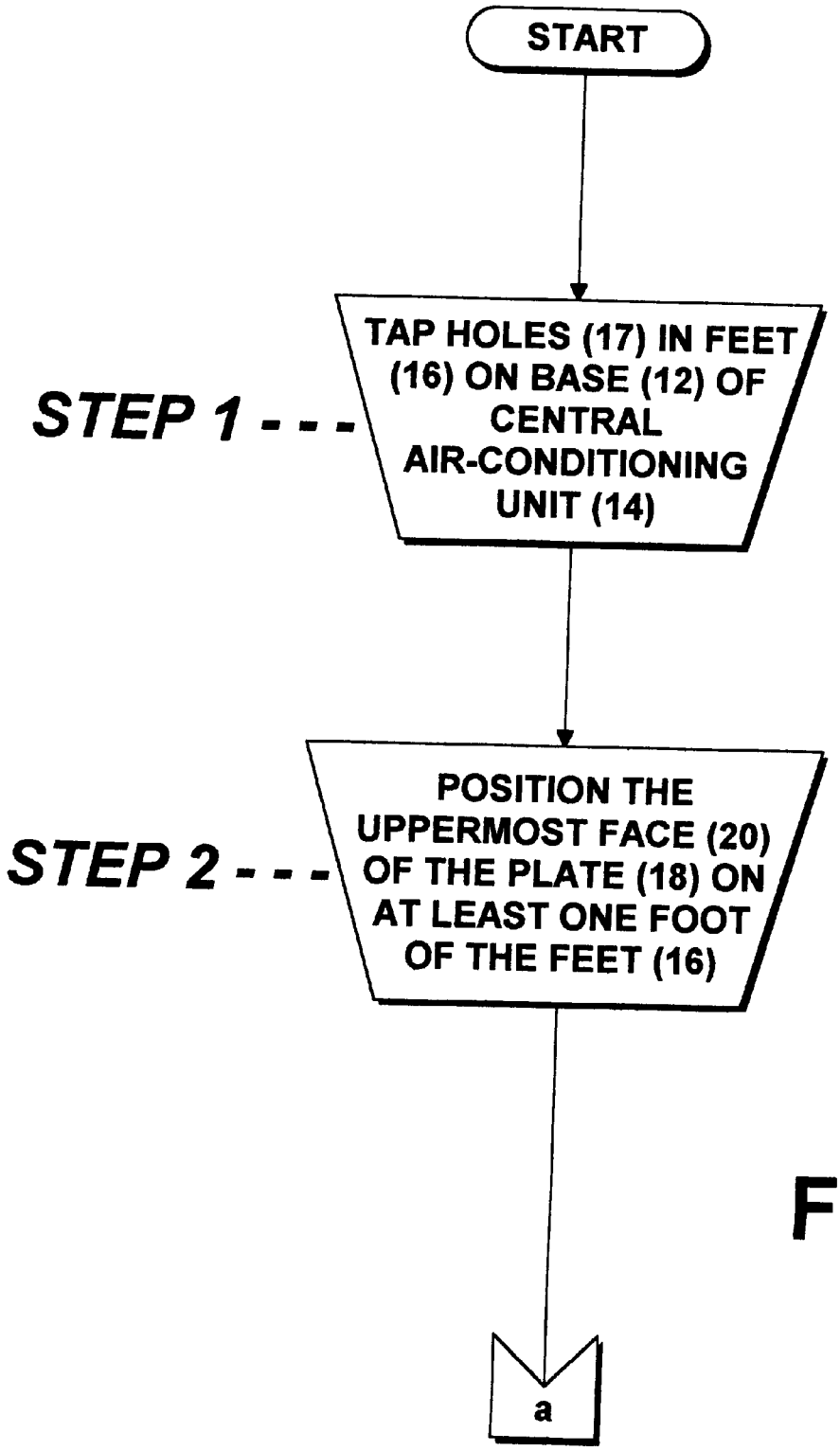
FIGS. 3A–3C are a process flow chart for utilizing the present invention.
Figure 3B:
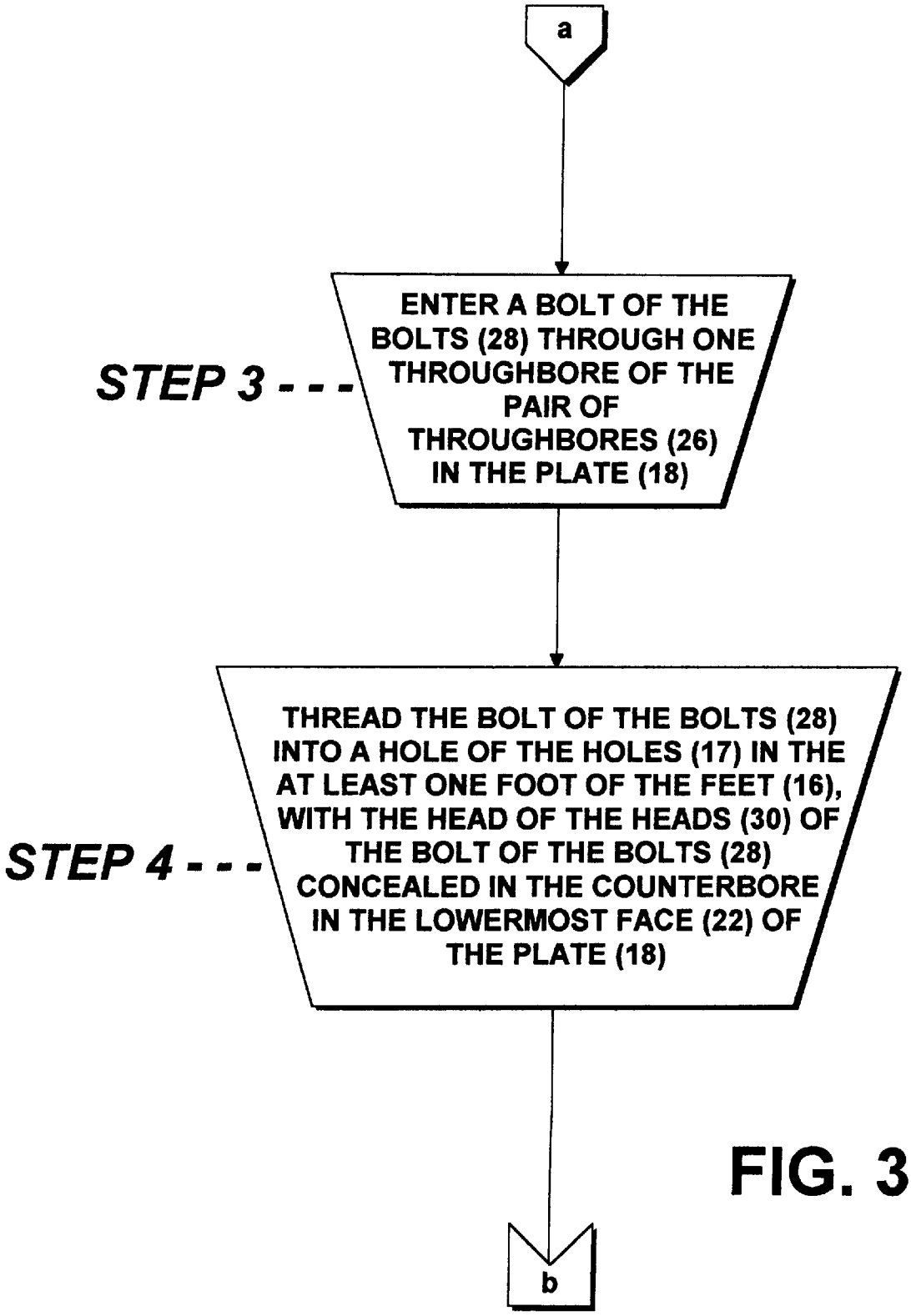
Figure 3C:
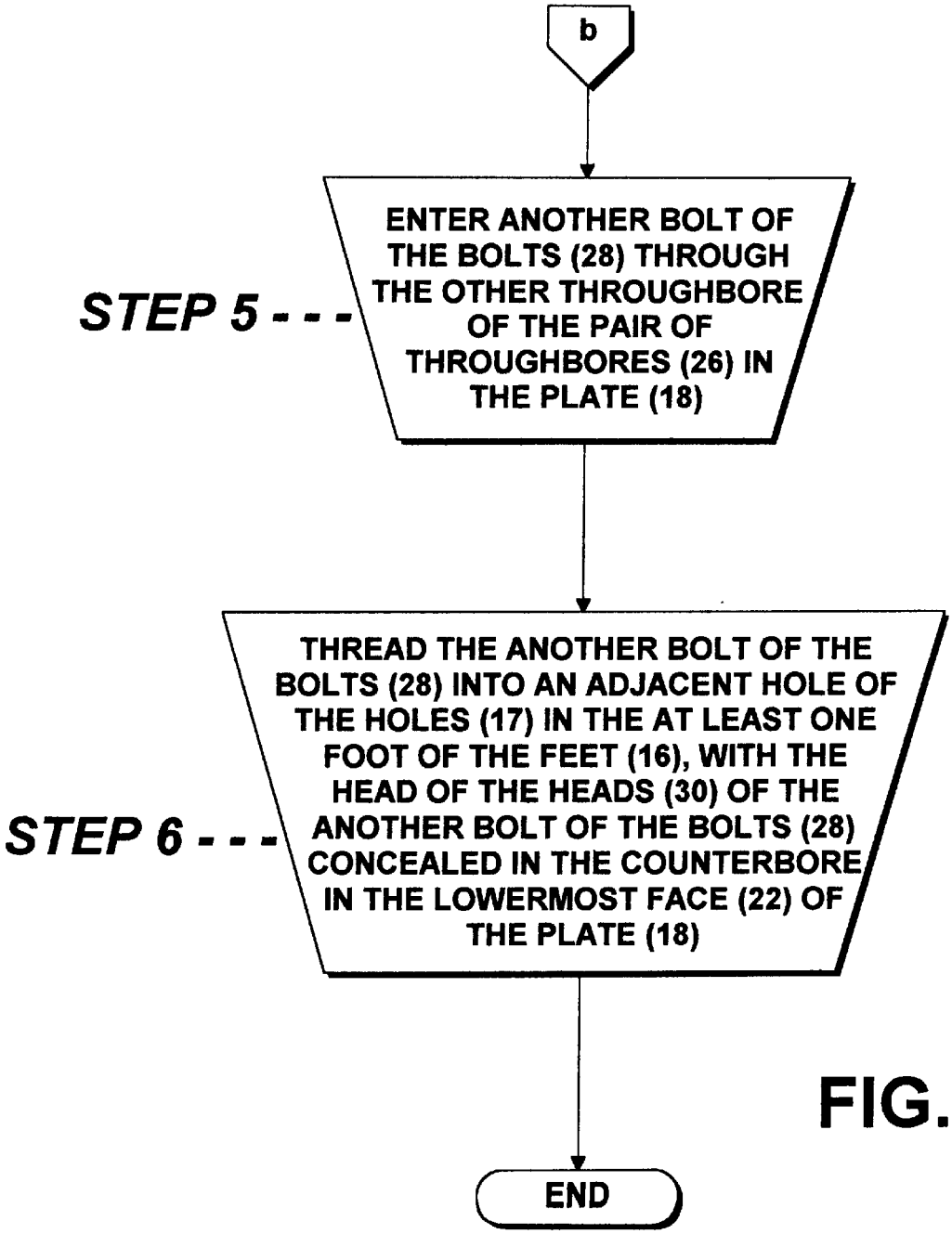

The method of utilizing the skid plate for protecting the base of a central air-conditioning unit from damage caused by transport and corrosion 10 can best be seen in FIGS. 3A–3C, and as such will be discussed with reference thereto.

STEP 1: Tap holes 17 in the feet 16 on the base 12 of the central air-conditioning unit 14.

STEP 2: Position the uppermost face of the plate 18 on at least one foot of the feet 16.

STEP 3: Enter a bolt of the bolts 28 through one throughbore of the pair of throughbores 26 in the plate 18.

STEP 4: Thread the bolt of the bolts 28 into a hole of the holes 17 in the at least one foot of the feet 16, with the head of the heads 30 of the bolt of the bolts 28 concealed in the counterbore in the lowermost face 22 of the plate 18.

STEP 5: Enter another bolt of the bolts 28 through the other throughbore of the pair of throughbores 26 in the plate 18.

STEP 6: Thread the another bolt of the bolts 28 into an adjacent hole of the holes 17 in the at least one foot of the feet 16, with the head of the heads 30 of the another bolt of the bolts 28 concealed in the counterbore in the lowermost face 22 of the plate 18.

It will be understood that each of the elements described above, or two or more together, may also find a useful application in other types of constructions differing from the types described above.

While the invention has been illustrated and described as embodied in a skid plate for protecting the base of a central air-conditioning unit from damage caused by transport and corrosion, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A skid plate for protecting the base of a central air-conditioning unit from damage caused by transport and corrosion, wherein the base of the central air-conditioning unit has feet depending therefrom with holes therein, said skid plate comprising a plate being slender, elongated, flat, and rectangular-parallelepiped-shaped, and having an uppermost face for contacting at least one foot of the feet on the base of the central air-conditioning unit, a lowermost face for contacting a concrete slab upon which the central air-conditioning unit is to rest, and a pair of throughbores that extend from said uppermost face of said plate to said lowermost face of said plate and which are axially spaced apart a distance equivalent to that distance between, and alignable with, a pair of adjacent holes of the holes in the feet on the base of the central air-conditioning unit, with said plate being for replaceably attaching to the feet on the base of the central air-conditioning unit by bolts that enter said pair of throughbores in said plate and threadably engage in the pair of adjacent holes of the holes in the feet on the base of the central air-conditioning unit, with said bolts having heads, and with said plate being replaceably attached to the feet on the base of the central air-conditioning unit to allow for its replacement when necessary.

2. The skid plate as defined in claim 1, wherein said plate plastic.

3. The skid plate as defined in claim 1, wherein said plate poly-vinyl-chloride.

4. The skid plate as defined in claim 1, wherein said plate a fluorocarbon polymer with slippery, non-sticking properties which is for facilitating pushing the central air-conditioning unit, as a result of its lower coefficient of friction.

5. The skid plate as defined in claim 1, wherein said plate is metal.

6. The skid plate as defined in claim 1, wherein said plate is stainless steel which resists corrosion.

7. The skid plate as defined in claim 1, wherein said pair of throughbores in said plate are counterbored on said lowermost face of said plate, a depth sufficient for preventing said heads of said bolts from protruding past said lowermost face of said plate, and with a width sufficient for allowing a socket to properly engage said heads of said bolts and turn said bolts.

8. A method for protecting the base of a central air-conditioning unit from damage caused by transport and corrosion, wherein the base of the central air-conditioning unit has feet depending therefrom with holes therein, said method comprising the step of attaching to the feet on the base of the central air-conditioning unit a skid plate which comprises a plate being slender, elongated, flat, and rectangular-parallelepiped-shaped, and having an uppermost face for contacting at least one foot of the feet on the base of the central air-conditioning unit, a lowermost face for contacting a concrete slab upon which the central air-conditioning unit is to rest, and a pair of throughbores that extend from said uppermost face of said plate to said lowermost face of said plate and which are axially spaced apart a distance equivalent to that distance between, and alignable with, a pair of adjacent holes of the holes in the feet on the base of the central air-conditioning unit, with said plate being replaceably attached to the feet on the base of the central air-conditioning unit by bolts that enter said pair of throughbores in said plate and threadably engage in the pair of adjacent holes of the holes in the feet on the base of the central air-conditioning unit, with said bolts having heads, and with said plate being replaceably attached to the feet on the base of the central air-conditioning unit to allow for its replacement when necessary.

9. The method as defined in claim 8, wherein said plate is plastic.

10. The method as defined in claim 8, wherein said plate is poly-vinyl-chloride.

11. The method as defined in claim 8, wherein said plate is a fluorocarbon polymer with slippery, non-sticking properties which is for facilitating pushing the central air-conditioning unit, as a result of its lower coefficient of friction.

12. The method as defined in claim 8, wherein said plate is metal.

13. The method as defined in claim 8, wherein said plate is stainless steel which resists corrosion.

14. The method as defined in claim 8, wherein said pair of throughbores in said plate are counterbored on said lowermost face of said plate, a depth sufficient for preventing said heads of said bolts from protruding past said lowermost face of said plate, and with a width sufficient for allowing a socket to properly engage said heads of said bolts and turn said bolts.

15. A method of utilizing a skid plate for protecting the base of a central air-conditioning unit from damage caused by transport and corrosion, wherein the base of the central air-conditioning unit has feet depending therefrom, said method comprising the steps of:

a) tapping holes in the feet on the base of the central air-conditioning unit;

b) positioning an uppermost face of a plate of said skid plate on at least one foot of the feet;

c) entering a bolt of bolts of said skid plate through one throughbore of a pair of throughbores in said plate;

d) threading said bolt of said bolts into a hole of said holes in the at least one foot of the feet, with a head of heads of said bolt of said bolts concealed in a counterbore in a lowermost face of said plate;

e) entering another bolt of said bolts through the other throughbore of said pair of throughbores in said plate; and f) threading said another bolt of said bolts into an adjacent hole of said holes in the at least one foot of the feet, with said head of said heads of said another bolt of said bolts concealed in an associated counterbore in said lowermost face of said plate.

16. The method as defined in claim 15, wherein said plate is plastic.

17. The method as defined in claim 15, wherein said plate is poly-vinyl-chloride.

18. The method as defined in claim 15, wherein said plate is a fluorocarbon polymer with slippery, non-sticking properties which is for facilitating pushing the central air-conditioning unit, as a result of its lower coefficient of friction.

19. The method as defined in claim 15, wherein said plate is metal.

20. The method as defined in claim 15, wherein said plate is stainless steel which resists corrosion.

* * * * *